US008899999B2

(12) United States Patent
Mackiewicz

(10) Patent No.: US 8,899,999 B2
(45) Date of Patent: Dec. 2, 2014

(54) TRACK ADAPTER AND LIGHTING FIXTURE

(71) Applicant: ABL IP Holding LLC, Conyers, GA (US)

(72) Inventor: Edwin Thomas Mackiewicz, Fayetteville, GA (US)

(73) Assignee: ABL IP Holding LLC, Conyers, GA (US)

( * ) Notice: Subject to any disclaimer, the term of this patent is extended or adjusted under 35 U.S.C. 154(b) by 30 days.

(21) Appl. No.: 13/625,425

(22) Filed: Sep. 24, 2012

(65) Prior Publication Data

US 2014/0085889 A1 Mar. 27, 2014

(51) Int. Cl.
*H01R 25/00* (2006.01)

(52) U.S. Cl.
USPC ..... 439/118

(58) Field of Classification Search
USPC ..... 439/116–119, 121, 122
See application file for complete search history.

(56) References Cited

U.S. PATENT DOCUMENTS

| | | | | | |
|---|---|---|---|---|---|
| 1,279,807 | A | | 9/1918 | White | |
| 1,410,325 | A | | 3/1922 | Kupferman | |
| 1,678,422 | A | | 7/1928 | Dugdill | |
| 1,909,947 | A | | 5/1933 | Greppin | |
| 2,981,917 | A | * | 4/1961 | Glass | 439/32 |
| 3,030,128 | A | | 4/1962 | Versen | |
| 3,094,584 | A | | 6/1963 | Liberman et al. | |
| 3,104,067 | A | | 9/1963 | Stiffel | |
| 3,273,103 | A | * | 9/1966 | Ericson | 439/43 |
| 3,295,093 | A | | 12/1966 | Neumann et al. | |
| 3,409,315 | A | | 11/1968 | Wichers et al. | |
| 3,503,032 | A | | 3/1970 | Routh et al. | |
| 3,559,146 | A | | 1/1971 | Valtonen | |
| 3,611,252 | A | | 10/1971 | Fremont | |
| 3,613,045 | A | | 10/1971 | Routh et al. | |
| 3,639,709 | A | * | 2/1972 | Hart et al. | 200/51 R |
| 3,646,501 | A | * | 2/1972 | Valtonen | 439/122 |
| 3,686,614 | A | | 8/1972 | Hyrylainen | |
| 3,757,063 | A | | 9/1973 | Hart et al. | |
| 3,757,273 | A | | 9/1973 | Hesse | |
| 3,760,133 | A | | 9/1973 | Howard | |
| 3,781,754 | A | * | 12/1973 | Seelbach | 439/94 |
| 3,792,413 | A | * | 2/1974 | Hyrlainen | 439/117 |
| 3,801,951 | A | * | 4/1974 | Kemmerer et al. | 439/116 |
| 3,825,879 | A | * | 7/1974 | Hesse | 439/117 |
| 3,832,503 | A | * | 8/1974 | Crane | 200/51 R |
| 3,848,715 | A | * | 11/1974 | Hesse | 191/45 R |
| 3,960,426 | A | | 6/1976 | Heritage | |
| 3,973,818 | A | | 8/1976 | Soquenne | |
| 3,993,385 | A | | 11/1976 | Seger | |
| 4,032,208 | A | * | 6/1977 | Berkenhoff | 439/122 |
| 4,038,705 | A | | 8/1977 | Owens et al. | |
| 4,108,523 | A | * | 8/1978 | Bolis | 439/116 |

(Continued)

*Primary Examiner* — Neil Abrams
(74) *Attorney, Agent, or Firm* — Kilpatrick Townsend & Stockton LLP

(57) ABSTRACT

Described are track adapters for snap-fitting within a recess of a track, the track adapters including at least one manually-releasable spring tab comprising a lip and a release tab; and at least one slidably-releasable spring tab comprising a lip, wherein the at least one manually-releasable spring tab and the at least one slidably-releasable spring tab are adapted to deflect inwardly to permit snap-fit insertion of the track adapter into the recess. Also described are light fixtures including a fixture head comprising at least one lamp housing, wherein the at least one lamp housing supports at least one lamp; and a curved arm connecting the fixture head to a support surface.

13 Claims, 13 Drawing Sheets

(56) References Cited

U.S. PATENT DOCUMENTS

| | | | | | |
|---|---|---|---|---|---|
| 4,121,879 | A | | 10/1978 | Olsen | |
| 4,211,460 | A | | 7/1980 | Seelbach et al. | |
| 4,218,108 | A | | 8/1980 | El Mouchi | |
| 4,289,365 | A | * | 9/1981 | Rutgers | 439/116 |
| 4,377,020 | A | | 3/1983 | Vigo | |
| 4,494,808 | A | | 1/1985 | Widell et al. | |
| 4,508,400 | A | * | 4/1985 | Herbert | 439/207 |
| 4,543,007 | A | | 9/1985 | Quiogue | |
| 4,548,446 | A | | 10/1985 | Warshawsky | |
| 4,557,547 | A | * | 12/1985 | Stuart | 439/677 |
| 4,582,445 | A | | 4/1986 | Warshawsky | |
| D290,524 | S | | 6/1987 | Kusmer | |
| 4,768,964 | A | * | 9/1988 | Zucchini | 439/110 |
| 4,778,397 | A | * | 10/1988 | Contant et al. | 439/116 |
| 4,815,740 | A | | 3/1989 | Williams et al. | |
| 4,822,292 | A | * | 4/1989 | Thayer et al. | 439/207 |
| 4,837,667 | A | | 6/1989 | Grau | |
| 4,919,625 | A | | 4/1990 | Coutre | |
| 5,039,118 | A | | 8/1991 | Huang | |
| 5,325,281 | A | | 6/1994 | Harwood | |
| 5,334,037 | A | * | 8/1994 | Gabrius et al. | 439/118 |
| 5,353,209 | A | * | 10/1994 | Foottit | 362/648 |
| 5,358,352 | A | | 10/1994 | Klarhorst | |
| 5,564,667 | A | | 10/1996 | Copeland et al. | |
| 5,655,833 | A | | 8/1997 | Raczynski | |
| 5,765,958 | A | | 6/1998 | Lan | |
| 5,788,518 | A | * | 8/1998 | Wachter et al. | 439/121 |
| 5,855,485 | A | | 1/1999 | Patti | |
| 5,869,786 | A | | 2/1999 | Jaakkola et al. | |
| 6,042,399 | A | | 3/2000 | Jaakkola | |
| 6,056,561 | A | * | 5/2000 | Lin | 439/121 |
| 6,059,582 | A | * | 5/2000 | Tsai | 439/121 |
| 6,079,992 | A | | 6/2000 | Kuchar et al. | |
| 6,113,401 | A | | 9/2000 | Nieminen et al. | |
| 6,203,339 | B1 | | 3/2001 | Nieminen | |
| 6,274,817 | B1 | | 8/2001 | Jaakkola et al. | |
| 6,513,962 | B1 | | 2/2003 | Mayshack et al. | |
| 6,517,363 | B2 | * | 2/2003 | Ross | 439/115 |
| 6,793,380 | B2 | | 9/2004 | Kupfer | |
| 6,799,876 | B2 | | 10/2004 | Ravier | |
| 6,902,200 | B1 | | 6/2005 | Beadle | |
| 6,994,571 | B2 | | 2/2006 | Hoffmann | |
| 7,070,293 | B2 | | 7/2006 | Seymour | |
| 7,086,875 | B2 | | 8/2006 | Hoffmann | |
| 7,320,610 | B2 | | 1/2008 | Boike | |
| 7,370,423 | B1 | | 5/2008 | Huang | |
| 7,591,604 | B2 | | 9/2009 | Roberts | |
| 8,251,566 | B1 | * | 8/2012 | Bartlett et al. | 362/648 |
| 8,469,728 | B1 | * | 6/2013 | Luksic et al. | 439/116 |
| 2004/0179891 | A1 | | 9/2004 | Watkins et al. | |
| 2006/0120092 | A1 | | 6/2006 | Sapper | |
| 2007/0258252 | A1 | | 11/2007 | Matts et al. | |
| 2008/0090432 | A1 | * | 4/2008 | Patterson et al. | 439/121 |
| 2009/0215004 | A1 | | 8/2009 | Whitman | |
| 2011/0141749 | A1 | | 6/2011 | Fishman et al. | |

* cited by examiner

TRACK ADAPTER AND LIGHTING FIXTURE

FIELD OF THE INVENTION

The field of the invention relates to track adapters and track lighting fixtures.

BACKGROUND

Known methods and apparatuses for mounting lighting fixtures into tracks traditionally require a certain amount of dexterity, typically requiring use of both of the installer's hands throughout the process. This necessity is especially troublesome given that an installer performing such a connection is typically also preoccupied with holding the light fixture(s) to be installed and maintaining his or her balance on a height support, such as a ladder or chair, during the installation process. These same issues may arise during removal of the light fixture from the track as well. Thus, it may be desirable to provide a track adapter that can be installed and removed easily with only one hand, freeing up an installer's other hand to perform other installation or safety tasks.

Additionally, known lighting methods and apparatuses exist for illuminating a selected surface. More sophisticated lighting methods and apparatuses, however, are required to allow for efficient adjustable and/or alternative illumination of multiple surfaces. The majority of these methods and apparatuses require the use of additional or optional directional lenses. Thus, it may be desirable to provide a lighting fixture that can be adjusted to efficiently illuminate multiple surfaces, including both vertical and horizontal surfaces, in an obround beam pattern without the need of additional and optional directional lenses.

SUMMARY

Certain embodiments of the present invention include a track adapter for snap-fitting within a recess of a track, the track adapter comprising: at least one manually-releasable spring tab comprising a lip and a release tab; and at least one slidably-releasable spring tab comprising a lip, wherein the at least one manually-releasable spring tab and the at least one slidably-releasable spring tab are adapted to deflect inwardly to permit snap-fit insertion of the track adapter into the recess. In some embodiments, the track adapter is removable from the recess by depression of the release tab of the at least one manually-releasable spring tab and rotation of the track adapter out of the track proximate the at least one manually-releasable spring tab, wherein the at least slidably-releasable spring tab deflects inwardly upon such rotation.

In some embodiments, the at least one manually-releasable spring tab comprises two manually-releasable spring tabs located on opposing sides of the track adapter. In some embodiments, the at least one slidably-releasable spring tab comprises two slidably-releasable spring tabs located on opposing sides of the track adapter. In some embodiments, the at least one slidably-releasable spring tab comprises a sloping side ramp. In some embodiments, the track adapter further comprises a locking mechanism.

Certain embodiments of the present invention also include a light fixture comprising: a fixture head comprising at least one lamp housing, wherein the at least one lamp housing supports at least one lamp; and a curved arm connecting the fixture head to a support surface. In some embodiments, the fixture head is rotationally or pivotally coupled to a distal end of the curved arm. In some embodiments, the at least one lamp housing comprises an inner gimbal to which a lamp is coupled.

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

BRIEF DESCRIPTION OF THE DRAWINGS

Illustrative embodiments of the present invention are described in detail below with reference to the following drawing figures.

DETAILED DESCRIPTION

Figure 1:
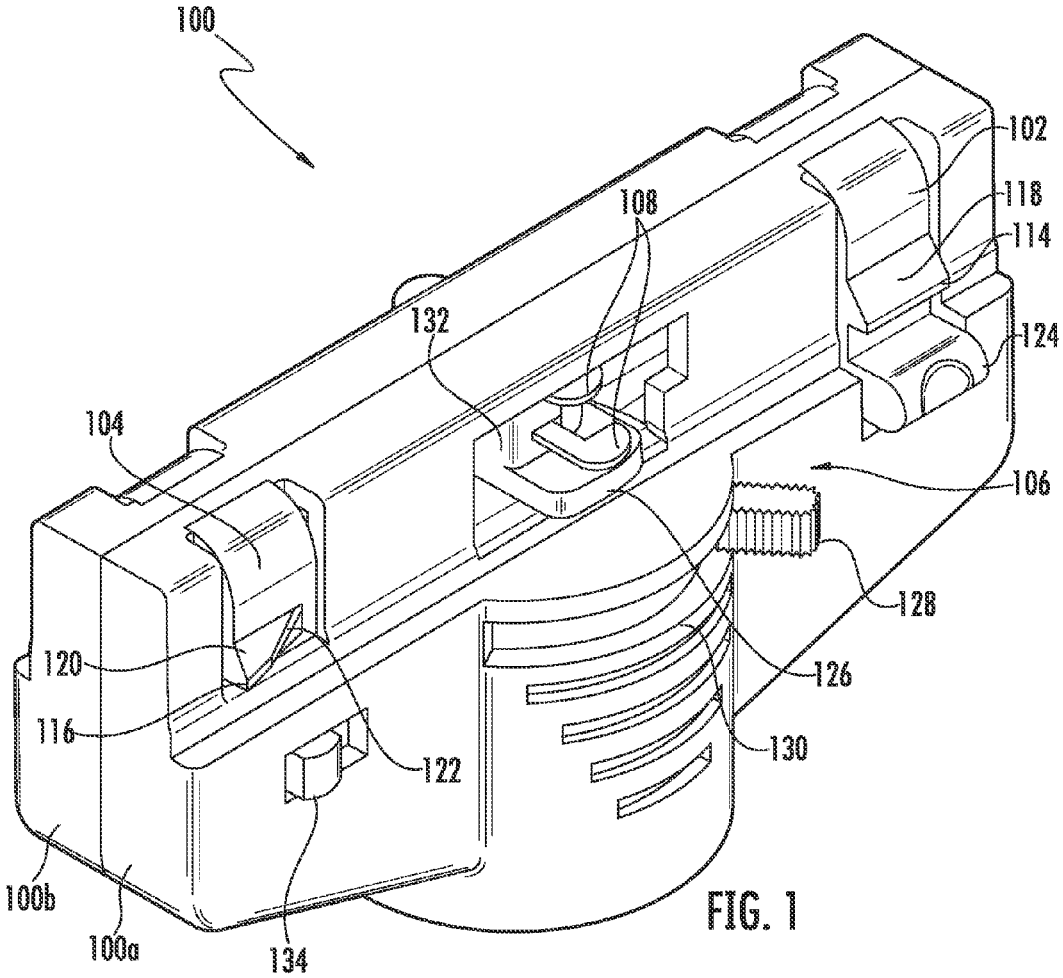
FIG. 1 is a perspective view of a track adapter according to certain embodiments of the present invention.
Figure 2:
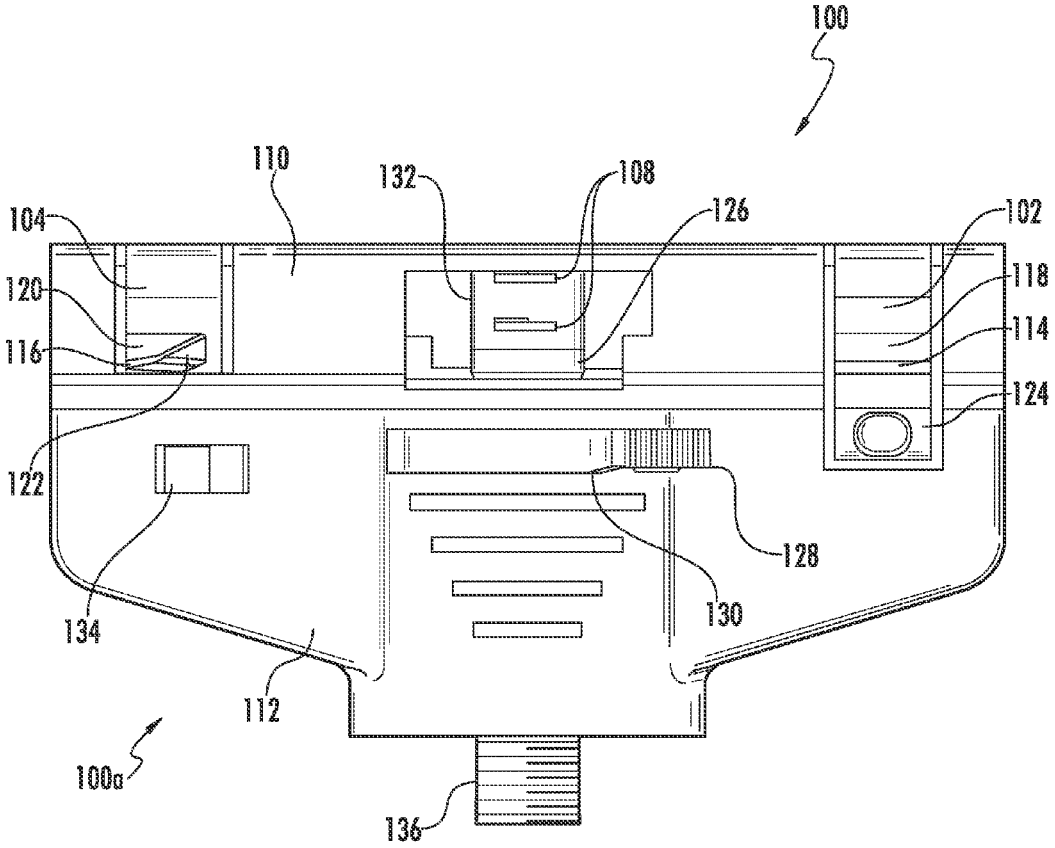
FIG. 2 is a front view of the track adapter of FIG. 1.
Figure 3:
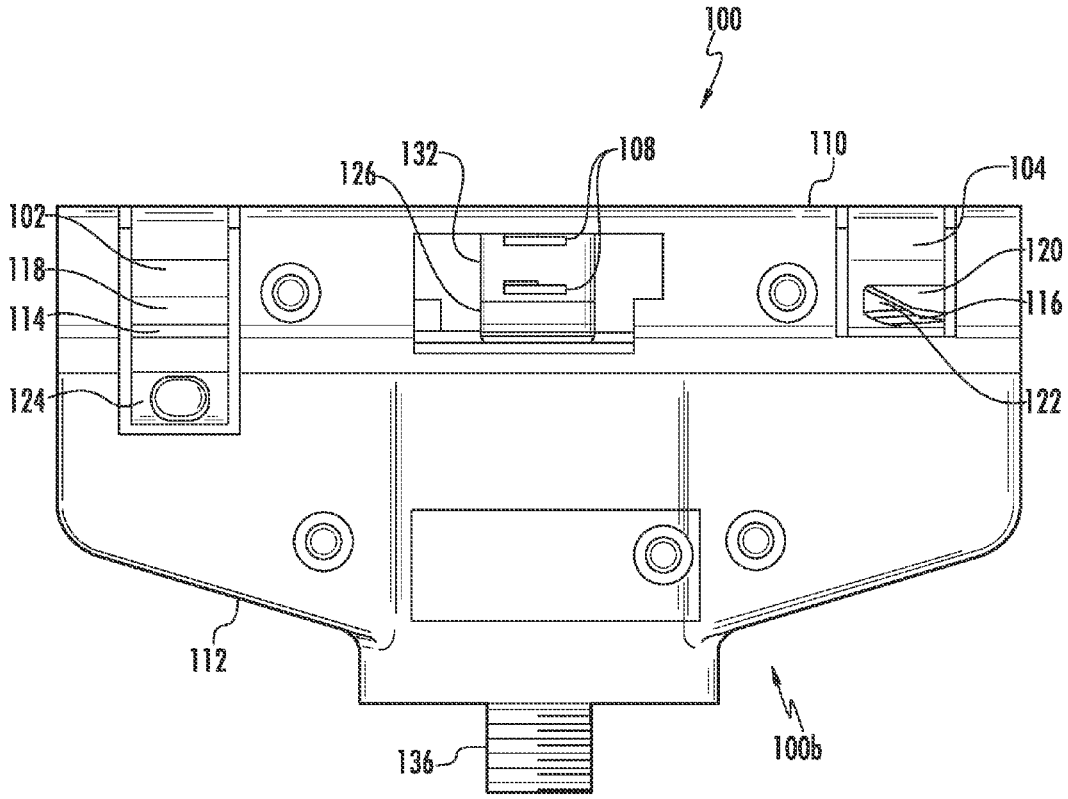
FIG. 3 is a rear view of the track adapter of FIG. 1.
Figure 4:
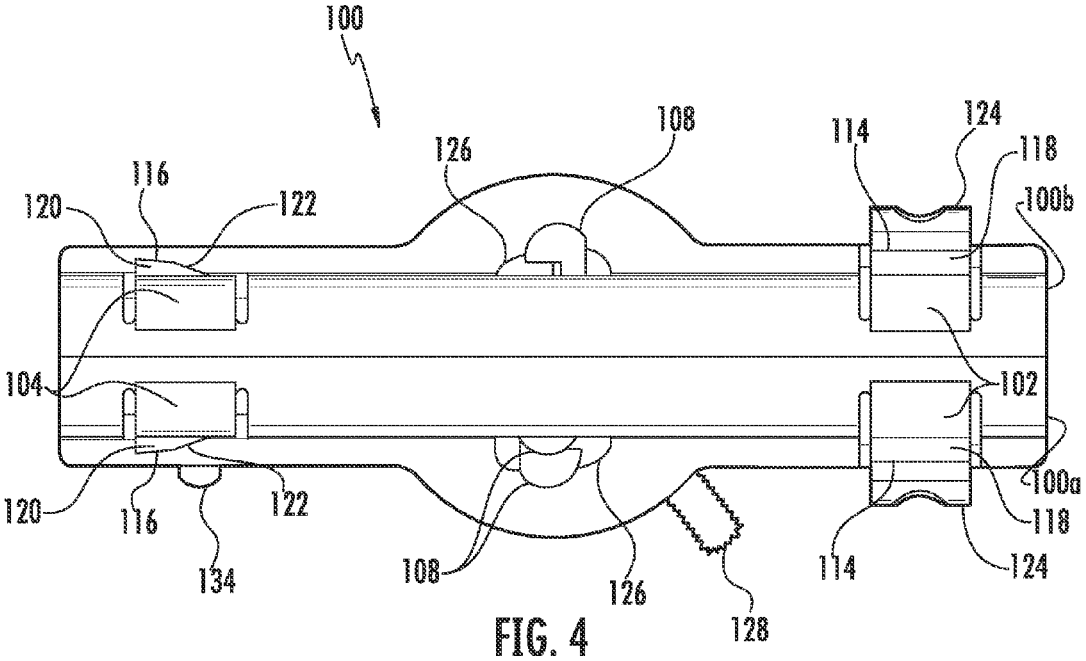
FIG. 4 is a top view of the track adapter of FIG. 1.
Figure 5:
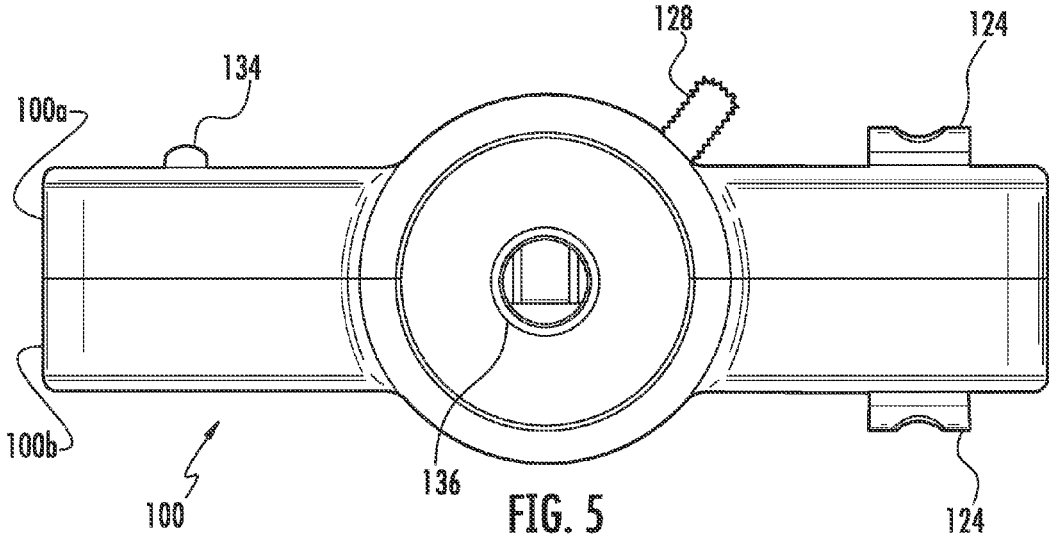
FIG. 5 is a bottom view of the track adapter of FIG. 1.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the invention provide lighting fixtures and track adapters for connecting lighting fixtures to tracks. While the track adapters are generally discussed for use with lighting fixtures, they are by no means so limited. Rather, embodiments of the track adapters may be used in connection with any fixture or apparatus sought to be connected to a track.

FIGS. 1-9 illustrate embodiments of a track adapter 100. In these embodiments, the track adapter 100 may comprise at least one manually-releasable spring tab 102 and at least one slidably-releasable spring tab 104. The manually-releasable spring tab 102 and the slidably-releasable spring tab 104 are adapted to depress inwardly to permit snap-fitting of the track adapter 100 into an inner recess 202 of a track 200. In some embodiments, such as the embodiments illustrated in FIGS. 1-7, the track adapter 100 may comprise a locking mechanism 106 that, when oriented in a "locked" position, may lock the track adapter 100 in position within the track 200. In some embodiments, such as the embodiments illustrated in FIGS. 1-7, the locking mechanism 106, when oriented in a "locked" position, may also expose at least one electrical contact 108 for electrically connecting the track adapter 100 to the track 200, as discussed in more detail below.

Figure 6:
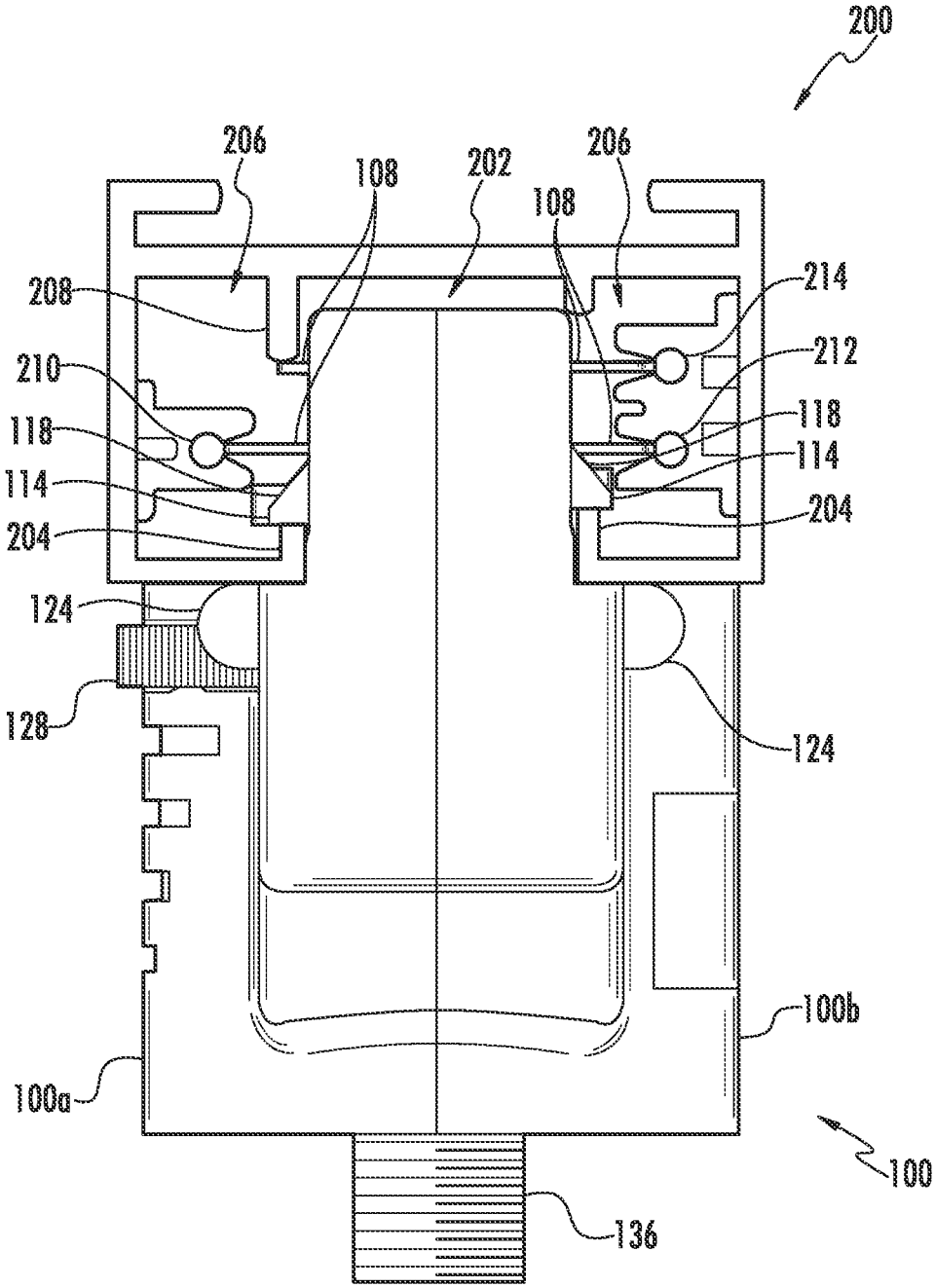
FIG. 6 is a right side view of the track adapter of FIG. 1, in combination with a track.
Figure 7:
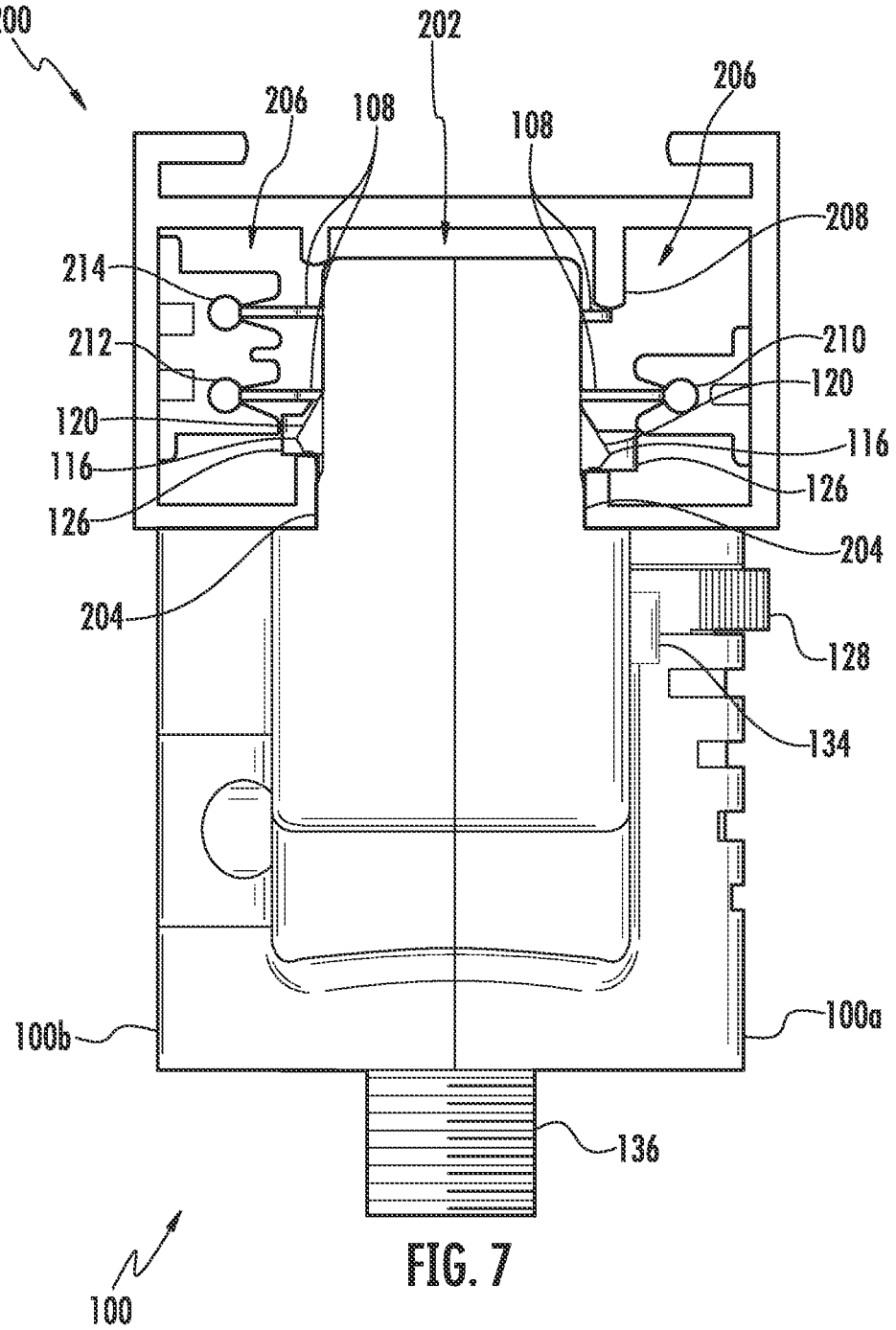
FIG. 7 is a left side view of the track adapter of FIG. 1, in combination with a track.
Figure 8:
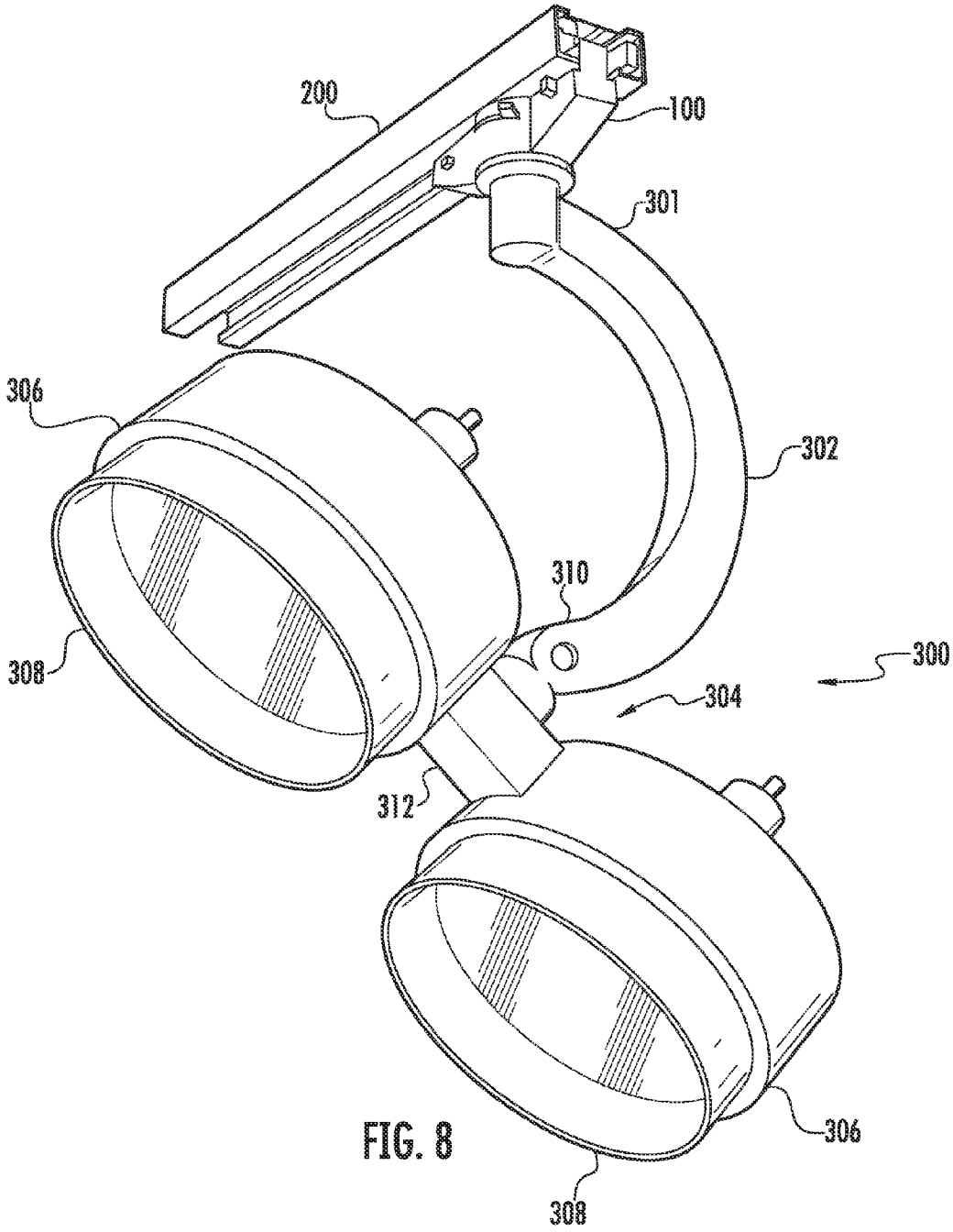
FIG. 8 is a perspective view of a track adapter according to certain embodiments of the present invention in combination with a track and a lighting fixture according to certain embodiments of the present invention.
Figure 9:
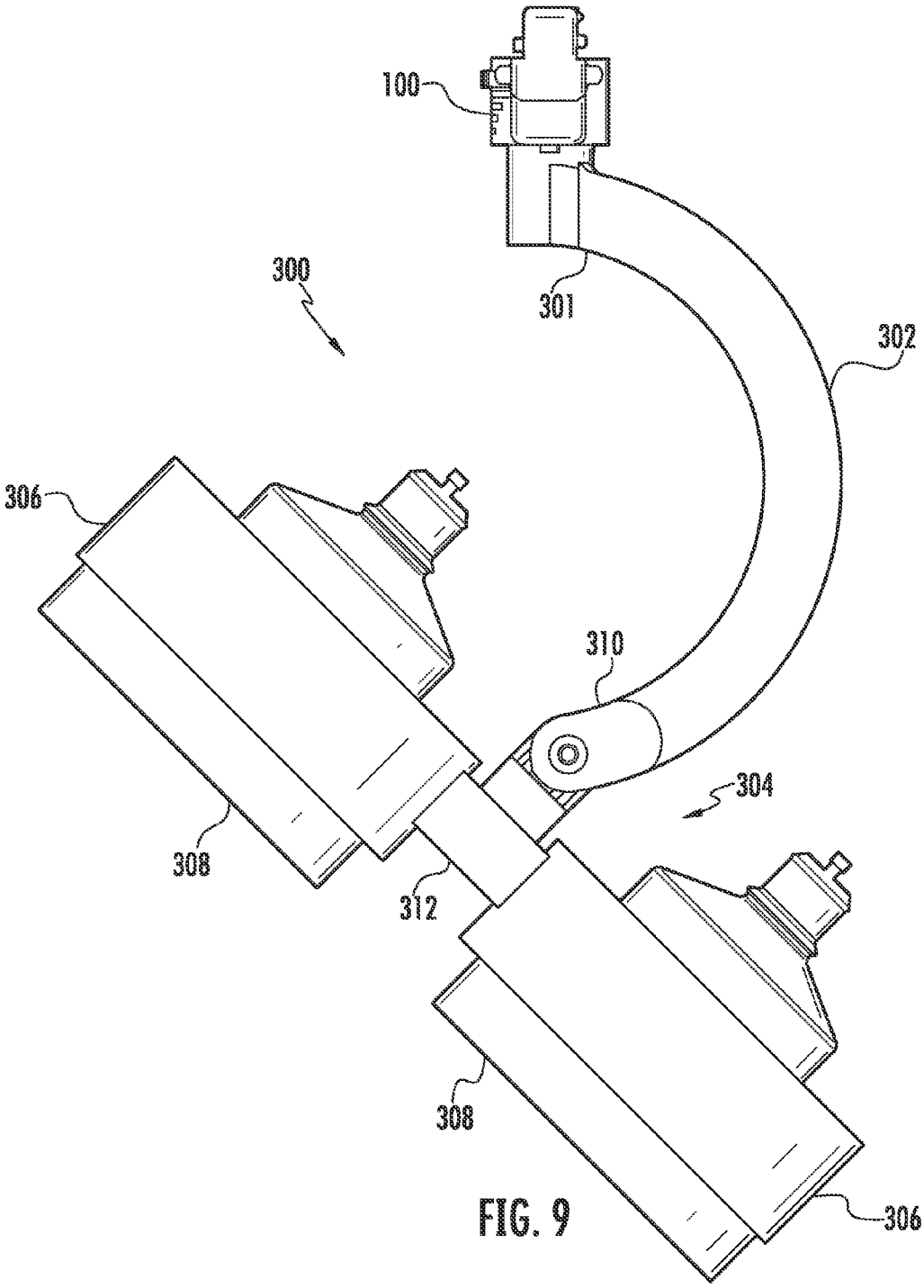
FIG. 9 is a side view of a track adapter according to certain embodiments of the present invention in combination with a lighting fixture according to certain embodiments of the present invention.
Figure 10:
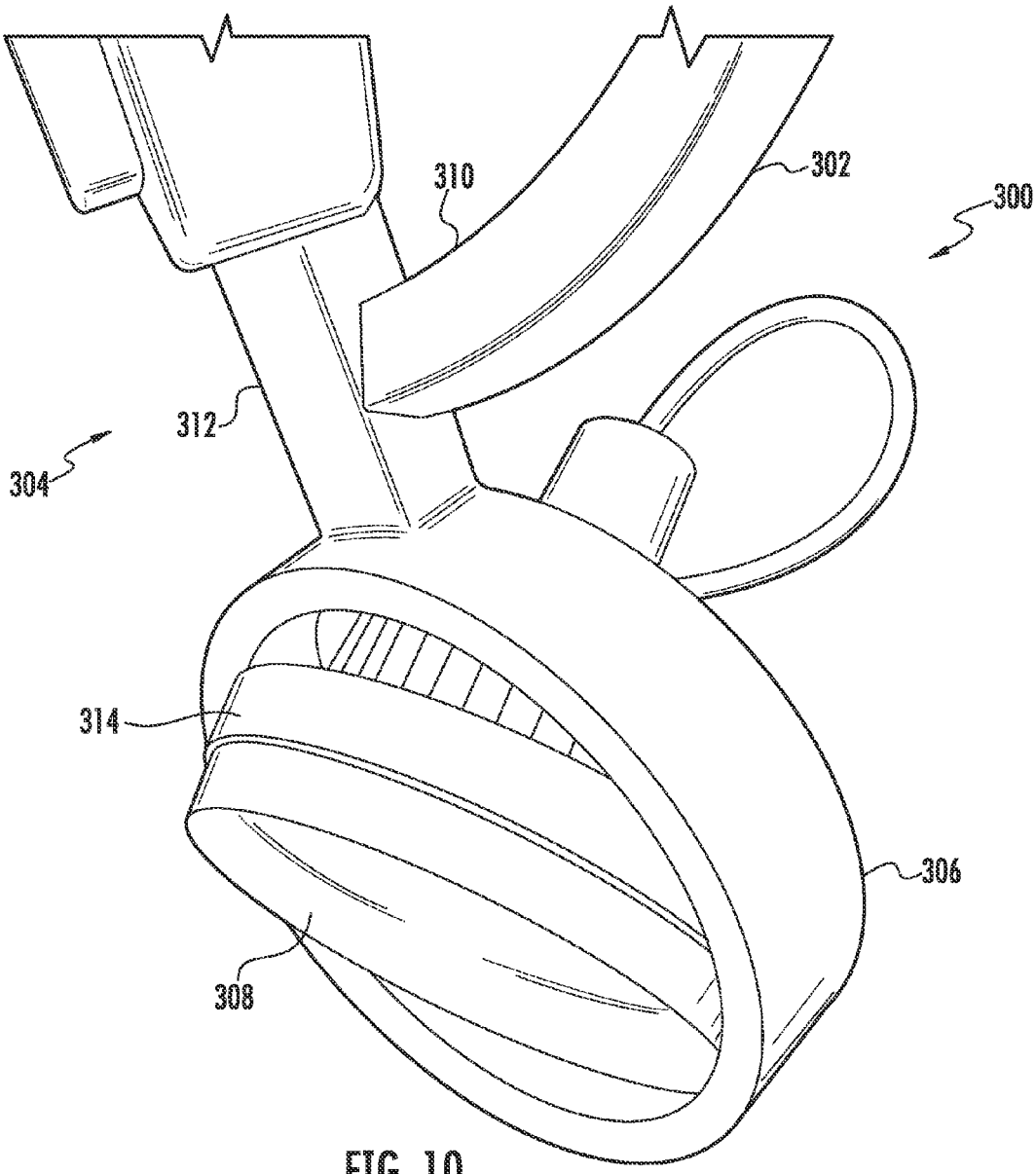
FIG. 10 is a perspective view of a lighting fixture according to certain embodiments of the present invention.
Figure 11:
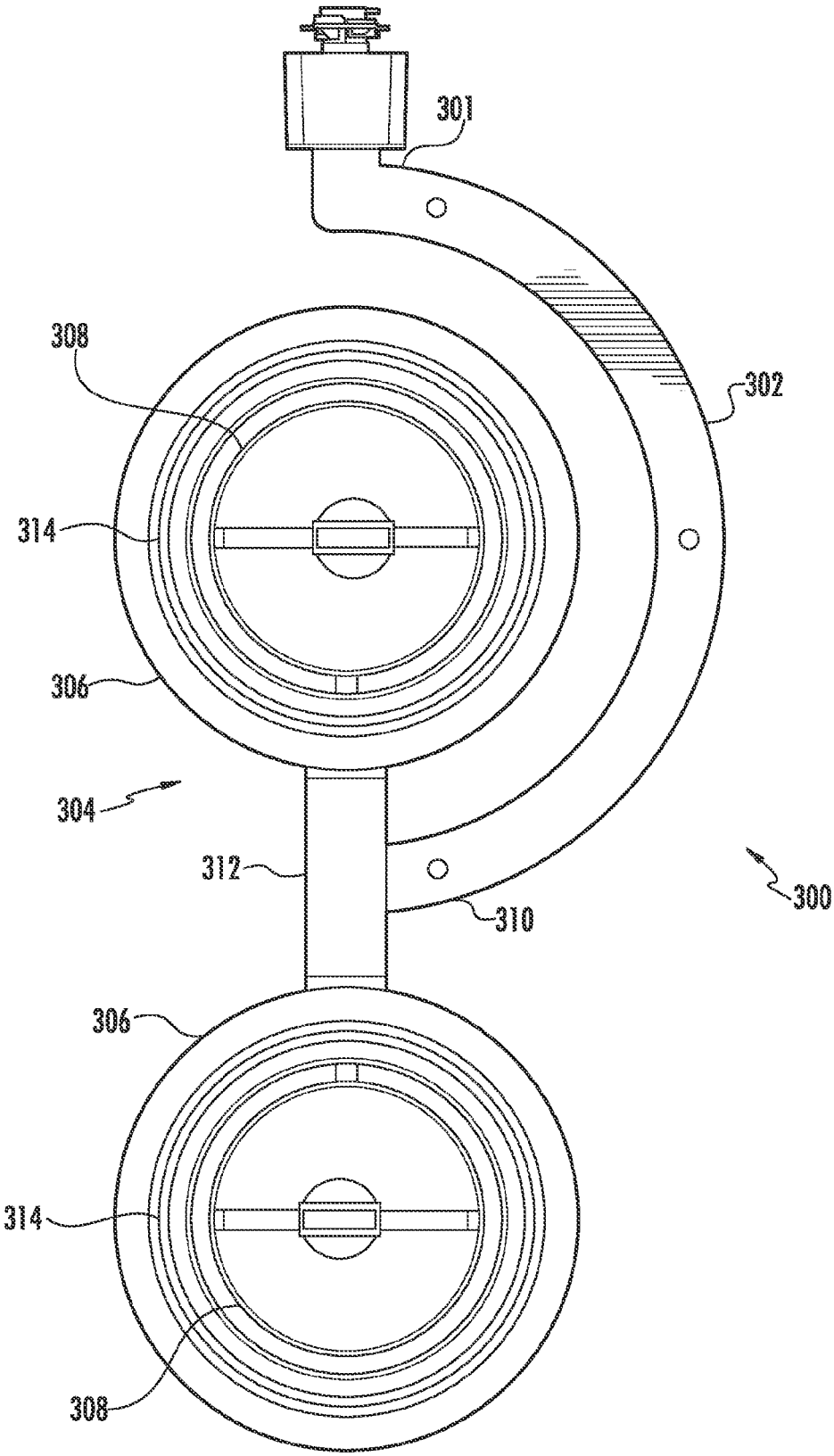
FIG. 11 is a front view of a lighting fixture according to certain embodiments of the present invention.
Figure 12:
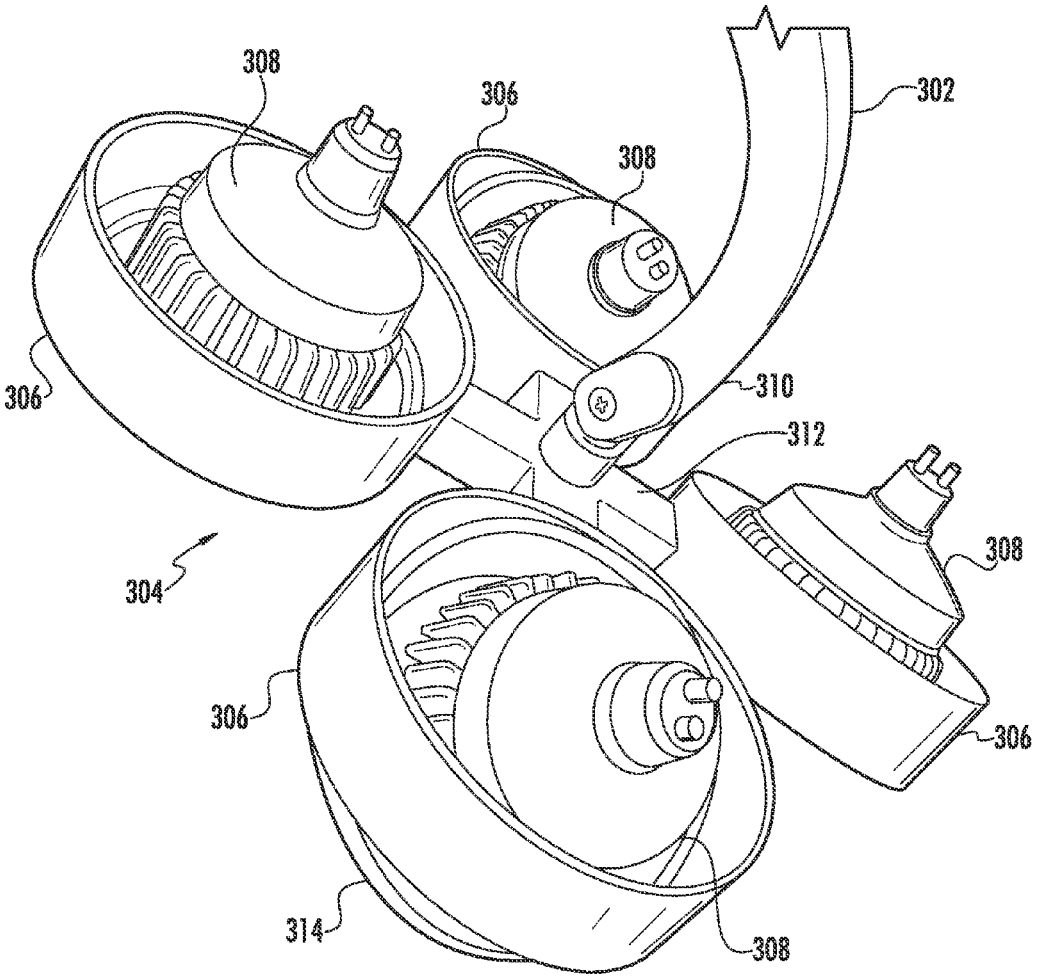
FIG. 12 is a perspective view of a lighting fixture according to certain embodiments of the present invention.
Figure 13:
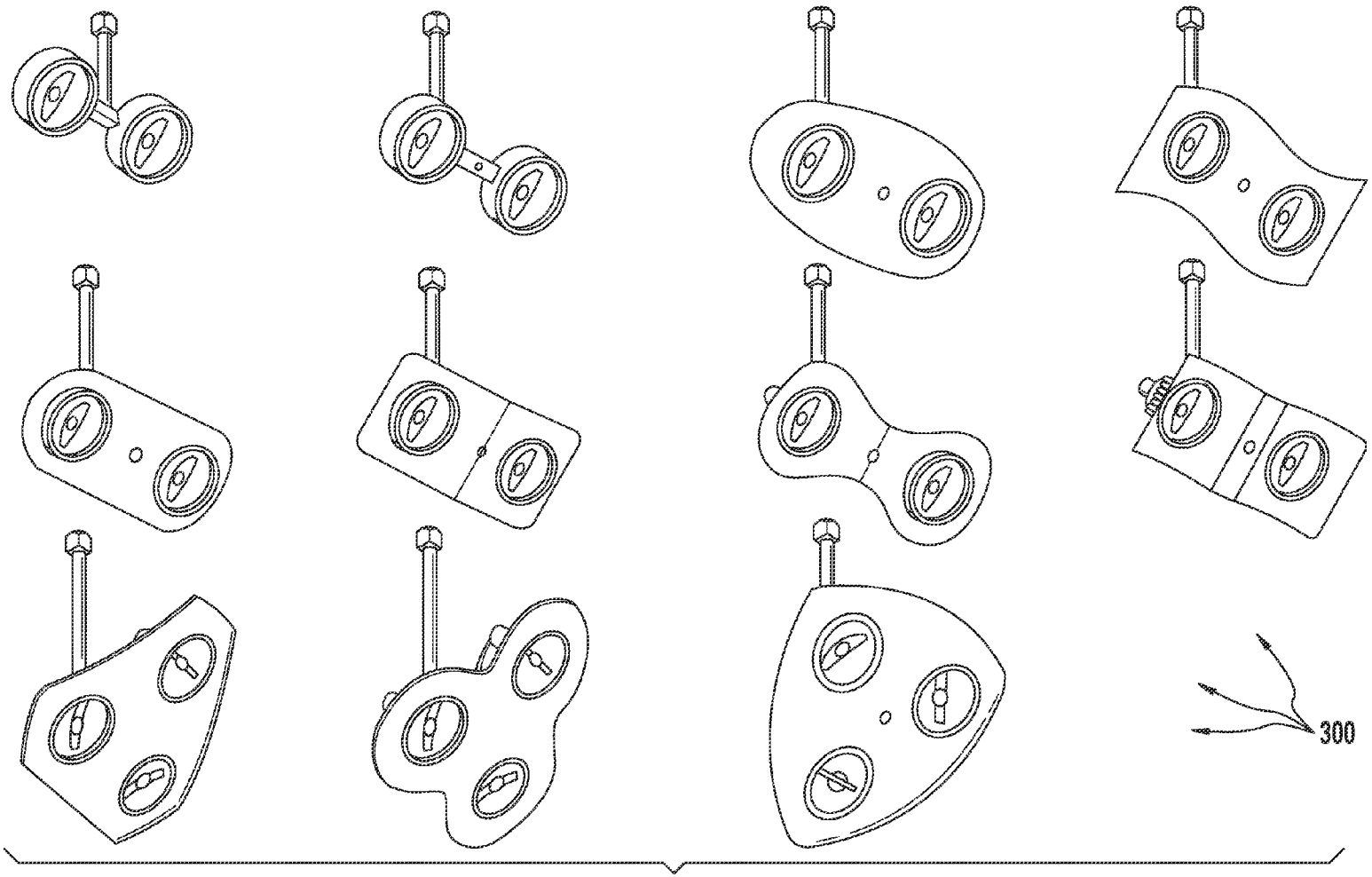
FIG. 13 is a view of a collection of lighting fixtures according to certain embodiments of the present invention.

The track adapter 100 connects a light fixture 300, or other fixture, to a track 200, as illustrated by example in FIGS. 6-8. In these embodiments, the track adapter 100 may be releasably coupled to the track 200. In some embodiments, the track adapter 100 may also be slidably coupled to the track 200, such that the track adapter 100 may be able to slide a length of the track 200 while remaining coupled to the track 200. The track adapter 100 may be formed of materials including but not limited to plastics, composite plastics, aluminum, other metallic materials, composite materials, or other similar materials. Throughout embodiments, the dimensions of the track adapter 100 may vary as needed, and may also vary dependent on the track 200. In some embodiments, the track adapter 100 may be formed of two or more parts, such as part 100*a* and part 100*b*, as illustrated in FIGS. 1 and 4-7. In these embodiments, part 100*a* may be coupled to part 100*b* by a variety of mechanisms, including but not limited to an adhesive, bolts, fasteners, screws, and other coupling mechanisms. In other embodiments, the track adapter 100 may be integrally formed.

In some embodiments, the track adapter 100 may comprise an upper portion 110 and a lower portion 112. In these embodiments, once the track adapter 100 is coupled to the track 200, as illustrated in FIGS. 6-7, the upper portion 110 may be housed within an inner recess 202 of the track 200 while the lower portion 112 remains outside of the track 200. In some embodiments, the upper portion 110 and lower portion 112 may be integrally formed. In other embodiments, the upper portion 110 may be coupled to the lower portion 112 by a variety of mechanisms, including but not limited to an adhesive, bolts, fasteners, screws, and other coupling mechanisms.

In some embodiments, the track adapter 100 may be designed to be snap-fit into the track 200, such as via the manually-releasable spring tab 102 and the slidably-releasable spring tab 104. In some embodiments, such as the embodiments illustrated in FIGS. 1-7, the track adapter 100 may comprise two or more manually-releasable spring tabs 102 and/or two or more slidably-releasable spring tabs 104, one on each side of the track adapter 100. In some embodiments, such as the embodiments illustrated in FIGS. 1-7, the spring tabs 102, 104 and the track adapter 100 may be integrally formed. In other embodiments, spring tabs 102, 104 may be pivotally coupled to the track adapter 100 by a variety of mechanisms, including but not limited to pins, fasteners, hinges, and other similar mechanisms. The spring tabs 102, 104 may be formed of materials including but not limited to plastics, composite plastics, aluminum, other metallic materials, composite materials, or other similarly malleable materials.

Each spring tab 102, 104 may include a respective lip 114, 116 that may extend outwardly from the spring tab 102, 104 along a respective downwardly sloping top surface 118, 120, as illustrated in FIGS. 1-7. The lip 116 of the slidably-releasable spring tab(s) 104 may also include a sloping side ramp 122 as well, as illustrated in FIGS. 1-4. The sloping side ramp 122 may facilitate removal of the track adapter 100 from the track 200, as discussed in more detail below. In some embodiments, lips 114, 116 are integrally formed with spring tabs 102, 104. In other embodiments, lips 114, 116 may be coupled to the spring tabs 102, 104 by a variety of mechanisms, including but not limited to an adhesive, bolts, fasteners, screws, and other coupling mechanisms. The lips 114, 116 may be formed of materials including but not limited to plastics, composite plastics, aluminum, other metallic materials, composite materials, or other similar materials.

The manually-releasable spring tab(s) 102 may further include at least one release tab 124, to facilitate removal of the track adapter 100, as discussed below. The release tab 124 may have any suitable cross-sectional shape including but not limited to circular, rectilinear, trapezoidal, or other similar polygonal shape. In some embodiments, release tab 124 is integrally formed with the manually-releasable spring tab(s) 102. In other embodiments, release tab 124 may be coupled to the manually-releasable spring tab(s) 102 by a variety of mechanisms, including but not limited to an adhesive, bolts, fasteners, screws, and other coupling mechanisms. The release tab 124 may be formed of materials including but not limited to plastics, composite plastics, aluminum, other metallic materials, composite materials, or other similar materials.

To insert the track adapter 100 into a track 200, the upper portion 110 of the track adapter 100 is positioned adjacent one or more arms 204 of the track 200 that define the opening into the inner recess 202. The lips 114, 116 initially prevent the upper portion 110 from fully entering the inner recess 202 between the arms 204. However, as upward pressure is applied to the track adapter 100, the arms 204 of the track 200 slide along the sloping top surfaces 118, 120 of the spring tabs 102, 104 and cause the spring tabs 102, 104 to depress inwardly to provide the necessary clearance for the upper portion 110 of the track adapter 100 to fully enter the inner recess 202. Once the lips 114, 116 clear the arms 204, the spring tabs 102, 104 return to their preloaded state, wherein, in some embodiments, the lips 114, 116 may rest atop the arms 204 (see FIGS. 6 and 7) to help prevent disengagement of track adapter 100 from track 200. When the track adapter 100 is positioned in track 200 as described above, the release tab 124 remains exposed outside of the inner recess 202 (see FIG. 6) so as to be accessible to the user during disengagement, as will be described below.

In some embodiments, once the track adapter 100 is engaged in the track 200, the user may quickly and easily lock the track adapter 100 in place in a desired location within the track 200 using the locking mechanism 106. In some embodiments, the user may also quickly and easily electrically connect the track adapter 100 to the track 200 using the locking mechanism 106.

In some embodiments, the locking mechanism 106 may comprise at least one locking bar 126 and a locking lever 128. In the embodiments illustrated in FIGS. 1-7, for example, the locking mechanism 106 comprises a locking lever 128 that may be rotated along a slot 130 from an unlocked position to a locked position (shown in FIGS. 1-5). In some embodiments, the at least one locking bar 126 (two are shown in the illustrated embodiments of FIGS. 1-7) may be fixedly coupled to the locking lever 128 by a shaft 132. As a result, rotation of the locking lever 128 may induce a corresponding rotation of the locking bar(s) 126. Specifically, when the locking lever 128 is located in a first position within slot 130, the locking bar(s) 126 is recessed within track adapter 100 so as to be in an unlocked position. However, rotation of locking lever 128 along slot 130 may result in rotation of the locking bar(s) 126 from the recessed, unlocked position to the locked position, wherein the locking bar(s) 126 extends outwardly from the track adapter 100, as illustrated in FIGS. 1-7.

The locking mechanism 106 may be formed of materials including but not limited to plastics, composite plastics, or other similar materials. The locking bar(s) 126 and the locking lever 128 may similarly be formed of materials including but not limited to plastics, composite plastics, or other similar materials. In some embodiments, the locking bar(s) 126 and locking lever 128 may integrally formed with the shaft 132. In other embodiments, the locking bar(s) 126 and locking lever 128 may be fixedly coupled to the shaft 132 by a variety of mechanisms, including but not limited to an adhesive, bolts, fasteners, screws, and other coupling mechanisms. One of ordinary skill in the relevant art, however, will understand that the locking mechanism 106 may comprise one or more other mechanisms, or combinations thereof, in addition to, or separate and distinct from, the components listed above.

After the track adapter 100 is positioned within the track 200, as discussed above, and possibly translated along the track 200 into the desired position, the track adapter 100 may be locked in position within the track 200 by rotating the locking lever 128 so that the locking bar(s) 126 rotates and extends outwardly from the track adapter 100 (i.e., into the locked position). As seen in FIGS. 6 and 7, the locking bar 126 extends above and abuts the arms 204 of the track 200 to prevent disengagement of the track adapter 100 from the track 200. In this locked position, as illustrated in FIGS. 6 and 7, the locking bar 126 resists or prevents movement of the track adapter 100 (e.g., by sliding) relative to the track 200. In some embodiments, the locking bar 126 resists or prevents such movement via a frictional force.

In some embodiments, the track adapter 100 may further comprise at least one electrical contact 108. In some embodiments, such as the embodiments illustrated in FIGS. 1-7, the track adapter 100 may comprise two or more electrical contacts 108. In these embodiments, the electrical contacts 108 may interact with the track 200 to supply electric current to the track adapter 100 (which, in turn, may drive the lighting fixture coupled to the track adapter 100). For example, in the embodiments illustrated in FIGS. 6-7, the electrical contacts 108 are designed and positioned to interact with a plurality of terminals 206 located within the track 200. In this illustrative example, the terminals 206 include a ground 208, neutral 210, "hot" line 1 212, and "hot" line 2 214. In these embodiments, the electrical contacts 108 are fixedly coupled to the shaft 132 of the locking mechanism 106. As a result, movement of the locking lever 128 induces a corresponding rotation of the electrical contacts 108. More specifically, when the locking lever 128 is moved into a locked position, the electrical contacts 108 rotate outwardly to automatically make the necessary connections with terminals 206. The electrical contacts 108 may be fixedly coupled to the shaft 132 by a variety of mechanisms, including but not limited to an adhesive, bolts, fasteners, screws, and other coupling mechanisms. The electrical contacts 108 may be formed of materials including but not limited to copper, aluminum, other metallic materials, or other similar conductive materials. One of ordinary skill in the relevant art, however, will understand that the electrical contacts 108 may take other forms and positions, in addition to, or separate and distinct from, the form and position listed above.

In some embodiments the track adapter 100 may further comprise an actuator 134 to control the flow of electric current to or through a portion of the track adapter 100 (e.g., via "hot" line 1 212 and/or "hot" line 2 214). In these embodiments, the actuator 134 may be directly manipulated by the user to control, alter, or otherwise manipulate the flow of electrical current to or through the track adapter 100. For example, in the embodiments illustrated in FIGS. 1-7, the actuator 134 may be a switch positioned on an external surface of the track adapter 100. In some embodiments, the actuator 134 may be automated, such as through a sensor mechanism. One of ordinary skill in the relevant art, however, will understand that the actuator 134 may take other forms and positions, in addition to, or separate and distinct from, the form and position listed above.

As discussed above, to engage the track adapter 100 with the track 200, the track adapter 100 is snap-fit into the track 200 using spring tabs 102, 104. This can be done by an installer with one hand. The track adapter 100 may then be slid along the length of the track 200 into the desired position while remaining coupled to the track 200. This step can be performed with one hand. Again using a single hand, the installer can engage the locking mechanism 106 by rotating the locking lever 128 so that the locking bar(s) 126 and electrical contacts 108 rotate outwardly to engage the arms 204 and terminals 206, respectively. In some embodiments, the actuator 134 may also be used to control, alter, or otherwise manipulate the flow of electrical current to or through a portion of the track adapter 100. This can be done by an installer with one hand.

To disengage the track adapter 100 from track 200, the locking mechanism 106 is first disengaged. More specifically, the locking lever 128 is rotated so that the locking bar(s) 126 and electrical contacts 108 rotate inwardly so as to become recessed within track adapter 100. Once the track adapter 100 is unlocked, it may be removed from the track 200. To remove the track adapter 100 from the track 200, the user may compress the release tab(s) 124 located on the manually-releasable spring tab(s) 102. This causes the manually-releasable spring tab(s) 102 to deflect inwardly, permitting the lip(s) 118 of the manually-releasable spring tab(s) 102 to disengage from the arms 204 of the track 200. The user may then pull the track adapter 100 away from the track 200 proximate the manually-releasable spring tab(s) 102. This step can be performed with one hand. The track adapter 100 remains engaged with the track 200 proximate the slidably-releasable spring tab(s) 104, however. But as track adapter 100 is rotated or otherwise pulled downwardly free of the track 200, the arms 204 begin to ride alongside the sloping side ramp 122 of the slidably-releasable spring tab(s) 104, eventually causing the slidably-releasable spring tab(s) 104 to depress inwardly and thereby permit disengagement of the entire track adapter 100 from the track 200. Thus, the embodiments of the track adapter 100 disclosed herein permit an installer to (1) engage (i.e., snap-fit) it into a track, (2) move it along a track, (3) lock it into position within a track, and (4) unlock and disengage it from a track, all quickly and easily, and in most instances requiring the use of only one hand.

FIGS. 8-13 illustrate embodiments of a light fixture 300. In these embodiments, the light fixture 300 comprises at least one arm 302 that supports a fixture head 304, which may include at least one lamp housing 306 and at least one lamp 308.

In some embodiments, a proximal end 301 of the arm 302 may couple the fixture head 304 to a support structure. In some embodiments, such as the embodiment illustrated in FIG. 8, the arm 302 may couple the fixture head 304 to a track adapter (such as, but not limited to, track adapter 100) to suspend the fixture head 304 from a track. By way only of example, in some embodiments, the track adapter 100 may be provided with a threaded male engagement structure 136 that engages a corresponding threaded female aperture in the proximal end 301 of arm 302 (not shown), such that the arm 302 is essentially screwed onto the track adapter 100. However, numerous other engagement mechanisms are contemplated herein, including but not limited to adhesive, bolts, screws, plugs, pins, prongs, receptacles, sockets, slots, and other similar mechanisms.

In some embodiments, the arm 302 may be coupled to the support structure or adapter so as to permit repositioning of the arm 302 relative to the support structure or adapter. For example, in some embodiments, the arm 302 may be coupled to the support structure or adapter to permit the arm 302 to rotate relative to the support structure or adapter. In these embodiments, the arm 302 may be pivotally coupled to the support structure or adapter by a variety of mechanisms, including but not limited to pins, fasteners, hinges, and other similar mechanisms. For example, in some embodiments, the arm 302 may be pivotally coupled to the support structure or adapter via a friction hinge, which relies on a constant friction force within the hinge to hold a position until an excessive torque is applied to overcome the hinge resistance torque and move the arm 302 to another position within its range of motion. As a result, the arm 302 may only be adjusted by direct, intentional force or manipulation by the user. In some embodiments, the friction force between the arm 302 and the support structure or adapter will likewise prevent unintentional adjustment of the arm 302. In other embodiments, the arm 302 may be secured into place after adjustment by a variety of mechanisms, including but not limited to a securing mechanism, adjustable fastener, or button mechanism.

The dimensions of the arm 302 may vary as needed. In some embodiments, such as the embodiments illustrated in FIG. 13, the arm 302 may be generally linear. In other embodiments, such as the embodiments illustrated in FIGS. 8-12, the arm 302 may be curved or otherwise non-linear. In these curved or otherwise non-linear embodiments, the arm 302 may alter the center of gravity of the light fixture 300, thereby balancing the light fixture 300 and minimizing or preventing a titling load stress on the support structure or adapter. The arm 302 may be formed of materials including but not limited to plastics, composite plastics, aluminum, other metallic materials, composite materials, or other similar materials. In some embodiments, the arm 302 may be formed of two or more parts.

The fixture head 304 is coupled to the arm 302. For example, in the embodiments illustrated in FIG. 8, the fixture head 304 is coupled to a distal end 310 of the arm 302. In some embodiments, the fixture head 304 may be fixedly coupled to the distal end 310 of the arm 302. In some embodiments, the fixture head 304 may be integrally formed with the arm 302. In other embodiments, such as the embodiments illustrated in FIGS. 8 and 9, the fixture head 304 may be rotationally and/or pivotally coupled to the distal end 310 of the arm 302 to allow rotation/pivoting of the fixture head 304 about the arm 302. In these embodiments, the fixture head 304 may be coupled to the arm 302 by a variety of mechanisms, including but not limited to pins, fasteners, hinges, friction hinges, and other similar mechanisms. In some embodiments, these coupling mechanisms may be largely internal (i.e., not visible from the outside of the fixture head 304). The fixture head 304 may be formed of materials including but not limited to plastics, composite plastics, aluminum, other metallic materials, composite materials, or other similar materials. In some embodiments, the fixture head 304 may be formed of two or more parts.

The fixture head 304 may include at least one lamp housing 306, which may house at least one lamp 308. The fixture head 304 may include any number of lamp housings 306 housing any number of lamps 308. For example, in the embodiments illustrated in FIGS. 8-11, the fixture head 304 includes two lamp housings 306 that each houses a lamp 308. The fixture head 304 of FIG. 9 includes four lamp housings 306 that each houses a lamp 308. The fixture head 304 may have a variety of different shapes and geometries, including, but not limited to, those shown in FIGS. 8-13 and is certainly not limited to the embodiments illustrated in the Figures.

For example, in the embodiments illustrated in FIG. 8, the fixture head 304 includes two lamp housings 306 connected by at least one crossbar 312, which, in turn, is coupled to the arm 302, as described above. In some embodiments, the lamp housings 306 may be integrally-formed with or otherwise fixedly coupled to the crossbar 312 so that their position relative to the crossbar 312 remains fixed. In other embodiments, the lamp housings 306 may be connected to the crossbar 312 so that the lamps 308 may move relative to the crossbar 312. More specifically, in some embodiments, the lamp housings 306 may act as gimbals that may pivot or rotate relative to the crossbar 312. Moreover, while the lamp 308 may be fixedly coupled to the lamp housing 306 in which it is positioned in some embodiments, in other embodiments, such as the embodiments illustrated in FIG. 10, the lamp housing 306 may include an inner gimbal 314, which may rotate relative to the lamp housing 306. In these embodiments, the lamp 308, in turn, may be mounted in the inner gimbal 314 and thus may be able to rotate relative to the lamp housing 306. In these embodiments, the inner gimbal 314 thus provides for additional degrees of freedom of the lamp 308, thus enabling, for example, counter-opposing illumination. The inner gimbal 314 may be formed of materials including but not limited to plastics, composite plastics, aluminum, other metallic materials, composite materials, or other similar materials. In still other embodiments, the lamp 308 may be pivotally mounted relative to the inner gimbal 314 so as to also be able to rotate relative to the inner gimbal 314.

The design of the light fixture 300 contemplates inclusion of a variety of different degrees of rotational freedom to permit customization and tailoring of the emitted light. By way only of example, in some embodiments it is possible to manipulate the light fixture 300 via rotation and/or pivoting of some or all of: (1) the arm 302 relative to a support structure or adapter; (2) the fixture head 304 relative to the arm 302; (3) the lamp housings 306 relative to crossbar 312; (4) the inner gimbal 314 relative to lamp housing 306; and/or (5) the lamp 308 relative to the inner gimbal 314. In this way, the fixture head 304 may be oriented vertically to illuminate vertical surfaces such as statues and mannequins, horizontally to illuminate table tops and jewelry cases, and anywhere in between.

The foregoing is provided for purposes of illustrating, explaining, and describing embodiments of the present invention. Further modifications and adaptations to these embodiments will be apparent to those skilled in the art and may be made without departing from the scope or spirit of the invention. Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

That which is claimed is:

1. A track adapter for snap-fitting within a recess of a track, the track adapter comprising:

(a) at least one manually-releasable spring tab comprising a lip and a release tab; and (b) at least one slidably-releasable spring tab comprising a lip;

wherein the at least one manually-releasable spring tab and the at least one slidably-releasable spring tab are adapted to deflect inwardly to permit snap-fit insertion of the track adapter into the recess;

wherein, when inserted into the recess, each lip abuts an arm within the track to prevent removal of the track adapter from the recess; and wherein, the track adapter is removable by depression of the release tab of the at least one manually-releasable spring tab and rotation of the track adapter out of the track proximate the at least one manually-releasable spring tab, wherein the at least slidably-releasable spring tab deflects inwardly upon such rotation.

2. The track adapter of claim 1, wherein the at least one slidably-releasable spring tab comprises a sloping side ramp.

3. The track adapter of claim 1, wherein the at least one manually-releasable spring tab comprises two manually-releasable spring tabs located on opposing sides of the track adapter.

4. The track adapter of claim 1, wherein the at least one slidably-releasable spring tab comprises two slidably-releasable spring tabs located on opposing sides of the track adapter.

5. The track adapter of claim 1, further comprising a locking mechanism.

6. The track adapter of claim 5, wherein the locking mechanism comprises:

(a) a shaft;

(b) a locking lever fixedly coupled to the shaft; and (c) at least one locking bar fixedly coupled to the shaft;

wherein rotation of the locking lever results in a corresponding rotation of the at least one locking bar.

7. The track adapter of claim 6, wherein the locking lever and the at least one locking bar are integrally formed with the shaft.

8. The track adapter of claim 6, further comprising at least one electrical contact fixedly coupled to the shaft, wherein rotation of the locking lever results in a corresponding rotation of the at least one electrical contact.

9. The track adapter of claim 8, further comprising an actuator.

10. A method of coupling a track adapter to a track comprising at least two arms that define an opening to a track recess, wherein the track adapter comprises at least one manually-releasable spring tab comprising a lip and a release tab, at least one slidably-releasable spring tab comprising a lip, and a locking mechanism comprising:

(a) a shaft;

(b) a locking lever fixedly coupled to the shaft; and (c) at least one locking bar fixedly coupled to the shaft, the method comprising:

inserting the track adapter into the track recess such that at least one of the at least two arms of the track deflects the at least one manually-releasable spring tab inwardly and at least one of the at least two arms of the track deflects the at least one slidably-releasable spring tab inwardly to permit snap-fit insertion of the track adapter into the track recess, wherein after inserting the track adapter into the track recess, the lip of each of the at least one manually-releasable spring and of the at least one slidably-releasable spring tab abuts at least one of the at least two arms of the track to retain the track adapter within the track; and securing the track adapter at a position within the track with the locking mechanism by rotating the locking lever to rotate the at least one locking bar, wherein the at least one locking bar engages at least one of the at least two arms of the track.

11. The method of claim 10, wherein the locking member further comprises at least one electrical contact fixedly coupled to the shaft and wherein the method further comprises electrically connecting the at least one electrical contact to the track by rotating the at least one locking lever.

12. The method of claim 10, further comprising sliding the track adapter along the track after inserting the track adapter into the track recess and before securing the track adapter at the position within the track.

13. A method of removing a track adapter from a track, wherein the track adapter comprises at least one manually-releasable spring tab comprising a lip and a release tab and at least one slidably-releasable spring tab comprising a lip, the method comprising:

(i) depressing the release tab of the at least one manually-releasable spring tab such that the lip of the at least one manually-releasable spring tab deflects inwardly;

(ii) rotating the track adapter away from the track proximate the at least one manually-releasable spring tab such that the deflected lip of the at least one manually-releasable spring tab disengages from the track;

(iii) continuing to rotate the track adapter away from the track proximate the at least one manually-releasable spring tab such that the lip of the at least slidably-releasable spring tab deflects inwardly and disengages from the track.

* * * * *